US011040463B2

(12) United States Patent
Baumer

(10) Patent No.: US 11,040,463 B2
(45) Date of Patent: Jun. 22, 2021

(54) SYSTEM AND METHOD FOR SPRAYING LIGHTWEIGHT INSULATING CONCRETE

(71) Applicant: EURL BAUMER DAMIEN, Malbrans (FR)

(72) Inventor: Damien Baumer, Malbrans (FR)

(73) Assignee: Eurl Baumer Damien, Malbrans (FR)

( * ) Notice: Subject to any disclaimer, the term of this patent is extended or adjusted under 35 U.S.C. 154(b) by 451 days.

(21) Appl. No.: 15/738,323

(22) PCT Filed: Jun. 29, 2016

(86) PCT No.: PCT/FR2016/000109
§ 371 (c)(1),
(2) Date: Dec. 20, 2017

(87) PCT Pub. No.: WO2017/001734
PCT Pub. Date: Jan. 5, 2017

(65) Prior Publication Data

US 2018/0186032 A1 Jul. 5, 2018

(30) Foreign Application Priority Data

Jun. 30, 2015 (FR) ..... 1501393

(51) Int. Cl.
*B28C 7/16* (2006.01)
*E04G 21/04* (2006.01)
(Continued)

(52) U.S. Cl.
CPC ..... *B28C 7/165* (2013.01); *B28C 7/163* (2013.01); *E04F 21/085* (2013.01); *E04F 21/12* (2013.01);
(Continued)

(58) Field of Classification Search
CPC ..... B28C 7/163; B28C 7/165; E04F 21/085; E04F 21/12; E04G 21/0436; E21D 11/10; E21D 11/105
See application file for complete search history.

(56) References Cited

U.S. PATENT DOCUMENTS 4,106,111 A * 8/1978 Rose ..... B01F 3/068 366/10
5,019,310 A * 5/1991 Kobayashi ..... B29B 7/488 264/122
2004/0092614 A1 5/2004 Hilton et al.

FOREIGN PATENT DOCUMENTS

BE 431 967 A 2/1939
DE 20 56 145 A1 6/1972
(Continued)

OTHER PUBLICATIONS

International Search Report as issued in International Patent Application No. PCT/FR2016/000109, dated Dec. 5, 2016.

*Primary Examiner* — Alexander M Weddle
(74) *Attorney, Agent, or Firm* — Pillsbury Winthrop Shaw Pittman LLP

(57) ABSTRACT

A method for coating a support with a lightweight insulating shotcrete, includes preparing the shotcrete by mixing, in predetermined proportions, at least a fibrous aggregate, a binder and water; pouring the prepared shotcrete in a tank; having at least one outlet; continuously moving the wet shotcrete in the tank until it reaches the or each outlet; sucking the wet shotcrete along a feeding pipe linking the outlet of the tank to a spraying gun, with a Venturi hose fed with pressurized air, included in the spraying gun; spraying the sucked shotcrete on the support with the spraying gun.

9 Claims, 8 Drawing Sheets

(51) Int. Cl.
*E21D 11/10* (2006.01)
*E04F 21/12* (2006.01)
*E04F 21/08* (2006.01)

(52) U.S. Cl.
CPC ..... *E04G 21/0436* (2013.01); *E21D 11/10* (2013.01); *E21D 11/105* (2013.01)

(56) References Cited

FOREIGN PATENT DOCUMENTS

| | | | | |
|---|---|---|---|---|
| EP | 0 378 437 | A2 | 7/1990 | |
| EP | 2863056 | A1 * | 4/2015 | ..... B28C 5/1292 |
| FR | 578 421 | A | 9/1924 | |
| FR | 2 923 242 | A1 | 5/2009 | |
| FR | 3 007 780 | A1 | 1/2015 | |
| GB | 260 424 | A | 11/1926 | |
| GB | 530 001 | A | 12/1940 | |
| JP | 2006-224651 | A | 8/2006 | |
| WO | WO 00/76644 | A1 | 12/2000 | |

* cited by examiner 40
41
42
43A
43B
45A
45B
49
50
51
52
53
54
55
56
59
60
61
D1
D2
D3
D4
D5
X
IX

SYSTEM AND METHOD FOR SPRAYING LIGHTWEIGHT INSULATING CONCRETE

CROSS-REFERENCE TO RELATED APPLICATIONS

This is the U.S. National Stage of PCT/FR2016/000109, filed Jun. 29, 2016, which in turn claims priority to French Patent Application No. 1501393, filed Jun. 30, 2015, the entire contents of all applications are incorporated herein by reference in their entireties.

FIELD OF THE INVENTION

The invention relates to the field of constructions, and more specifically to the thermal or acoustic insulation of buildings by spraying a lightweight shotcrete.

BACKGROUND OF THE INVENTION

Shotcrete has been known for a long time, as shown by French Patent FR 578 421 (1924), disclosing a shotcrete spraying device using pressurized air.

Among the shotcrete spraying techniques, there exist the wet-mix and the dry-mix versions. In the wet-mix version, water is added to the mixture including the aggregate and the binder to obtain the shotcrete before its spraying on the site to cover. In the dry-mix version, water is added to the mixture at the very moment of the spraying. The wet-mix version has long been (and still is) used for mineral concretes and mortars.

Recently, techniques were imagined for spraying lightweight insulating shotcretes, and more specifically shotcretes in which the aggregate is a plant aggregate (e.g. hemp shive, which is the fragmented lower part of the hemp stem). One may e.g. refer to French Patent Application No. FR 2 923 242, which discloses a low-density shotcrete spraying method wherein a dry mixture is obtained by homogenizing a lightweight plant aggregate (such as hemp shive) with a binder; that dry mixture is then displaced in a pneumatic way by means of a blower; the dry mixture is humidified during its displacement by water dispersion; then the such obtained concrete is sprayed onto a surface.

That method, which is in-between the wet-mix version (allegedly unsuitable to compressible shotcretes, according to FR 2 923 242) and the dry-mix version (the important volume of which would lead, according to FR 2 923 242, to jamming and obstructions in the metering devices), is however not exempt of drawbacks.

Firstly, the dosage of the shotcrete is complex, especially because it is difficult to master the flow rate of the dry mixture (moreover if the pressure generated by the blower is not settable).

Secondly, as humidification is provided immediately before the spraying, the water only partly impregnates the dry mixture. The fraction of mixture which remains dry is nevertheless sprayed but does not aggregate to the surface to cover and, bouncing back, scatters around, resulting in material loss. In order to minimize the loss, fully admitted by FR 2 923 242, this document proposes to recycle the scattered material. This solution is theoretically satisfactory; however, in practice, recycling the scattered material takes time, and the recycled material requires a dedicated metering device. In addition, the dry-mix scattering generates dust, which, given the presence of fibers and binder (cement or lime), may attack the respiratory system. One may increase the water rate but this solution is excluded because of the risk of humidifying the aggregate (this is specifically forbidden by FR 2 923 242).

One object is to propose a method and a system for spraying wet-mix shotcrete, which allow, either separately or together:

- To enhance actual yields
- To minimize loss
- To minimize dust
- To optimize water consumption
- To spray a lightweight shotcrete including a fast set binder.

SUMMARY OF THE INVENTION

To that end, it is proposed, in a first aspect, a method for coating a support by means of a lightweight insulating shotcrete, including the following operations:

- Preparing the shotcrete by mixing, in predetermined proportions, at least a fibrous aggregate, a binder and water;
- Pour the prepared shotcrete in a tank having at least one outlet;
- Continuously move the wet shotcrete in the tank until it reaches the or each outlet;
- Suck the wet shotcrete along a feeding pipe linking the outlet of the tank to a spraying gun, by means of a Venturi hose fed with pressurized air, included in the spraying gun;
- Spraying the sucked shotcrete on the support by means of the spraying gun.

This wet-mix spraying method allows to maximize the output (and hence the yield) while optimizing the water consumption and minimizing dust.

Various additional features of this method may be provided, either alone or in combination:

- The aggregate is hemp shive;
- The binder is natural quick-setting cement;
- The shotcrete contains a water retainer adjuvant.
- The shotcrete contains a set retarder.
- The pressure inside the spraying gun next to the Venturi hose is lower than 0.3 bar.

It is proposed, in a second aspect, a spraying system for insulating lightweight shotcrete, comprising:

- A container provided with a tank and at least one forth worm screw rotatably mounted in the tank, the tank having at least one primary outlet facing the forth worm screw;
- A spraying gun provided with a barrel, with a Venturi hose opening in the barrel and with a primary inlet duct opening in the barrel next to the Venturi hose;
- A pressurized air source connected to the Venturi hose;
- At least one primary feeding pipe connecting the primary outlet of the tank to the primary inlet duct of the spraying gun.

Various additional features may be provided, either alone or in combination:

- The container comprises a return worm screw mounted parallel to the forth worm screw and driven in rotation in a opposite direction;
- The tank is provided with a secondary outlet next to the forth worm screw, the spraying gun is provided with a secondary inlet duct opening in the barrel, and the system comprises a secondary feeding pipe connecting the secondary outlet of the tank to the secondary inlet duct;

The secondary inlet duct opens next to the primary inlet duct.

The above and further objects and advantages of the invention will become apparent from the detailed description of preferred embodiments, considered in conjunction with the accompanying drawings.

DETAILED DESCRIPTION

Figure 1:
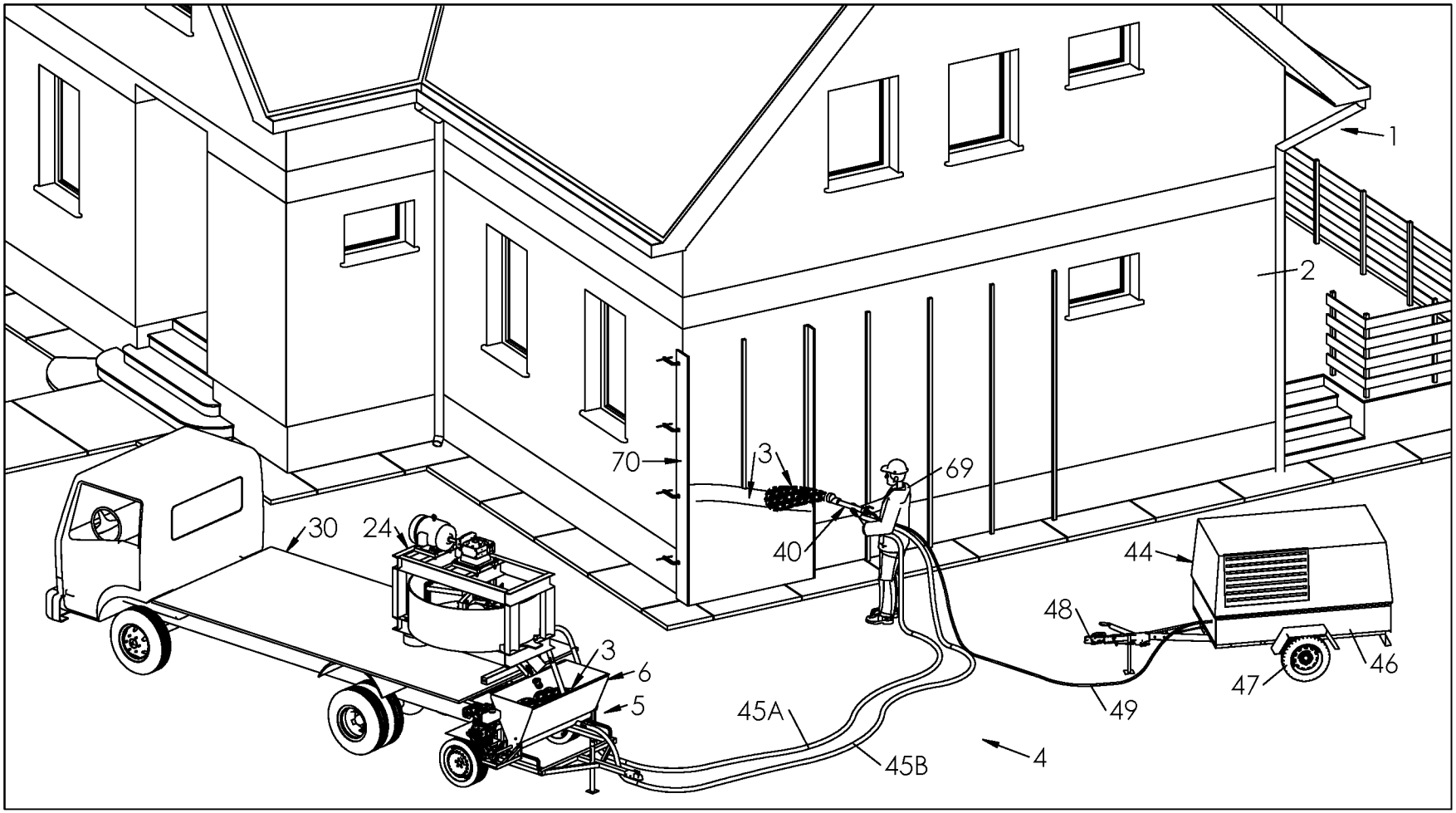
FIG. 1 is a perspective view showing a construction site for outer coating a building with a lightweight shotcrete spraying system.

FIG. 1 shows a construction site for insulating a building 1. The nature of the building 1 is irrelevant; here it is a house, but it might be a block building, an outbuilding, a garage, a shelter.

The building 1 comprises, in a known manner, masonries 2 (including frontage, side walls, floors, slabs), covered with a roofing. Here, the constructions site aims at coating the masonry 2 (e.g. the side wall facing the prevailing wind) with a sprayed layer of a lightweight insulating shotcrete 3, composing examples of which shall be provided hereinafter.

The coating is provided by means of a spraying system 4 which may be transported on site (as illustrated). This spraying system 4 comprises, firstly, a container 5 provided with a tank 6 in which the ready shotcrete 3 is poured, and at least one forth worm screw 7. The tank 6 has at least one primary outlet 8A, located next to the forth worm screw 7.

The forth worm screw 7 is rotatably mounted in the tank 6 to continuously move the shotcrete 3 until it reaches the primary outlet 8A. The tank 6 comprises a pair of inclined longitudinal walls 9, connected through two transverse ending walls, i.e. an upstream transverse wall 10 and a downstream transverse wall 11. The tank 6 has an opening 12 through which the shotcrete 3 is poured and, opposite the opening 12, a gutter-shaped bottom 13.

The forth worm screw 7 is an Archimedes (preferably stainless) steel screw, including a shaft 14 mounted between the transverse walls 10, 11, and a propeller 15 fixed to the shaft 14. The outer diameter of the propeller 15, substantially equal (possibly with a few millimeters gap) to the inner diameter of the bottom 13 of the tank 6, is comprised between 100 mm and 200 mm, and preferably of about 125 mm. The pitch of the propeller 15 is comprised between 100 mm and 200 mm, and preferably of about 125 mm. The diameter of the shaft 14 is comprised between 20 mm and 40 mm, and e.g. of about 30 mm.

The forth worm screw 7 is rotatably mounted with respect to the tank 6 (and more precisely with respect to the transverse walls 10, 11 by means of bearings, preferably ball bearings. At an upstream end, the shaft 14 has a cantilevered section 16 which protrudes from the tank 6 and to which a wheel 17 (pulley or gear wheel) is fixed.

Figure 3:
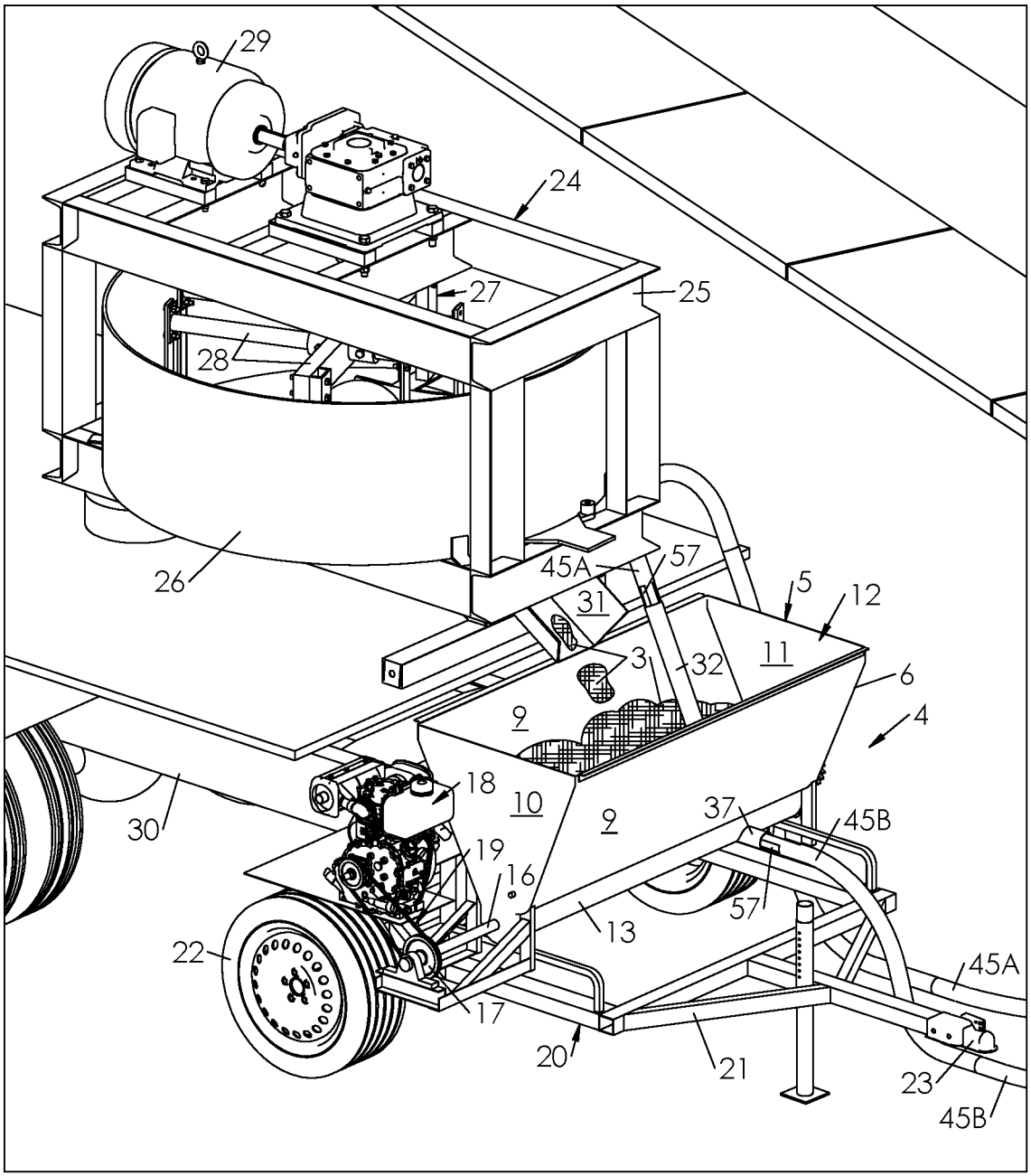
FIG. 3 is a detailed view, at a larger scale, of FIG. 1.
Figure 4:
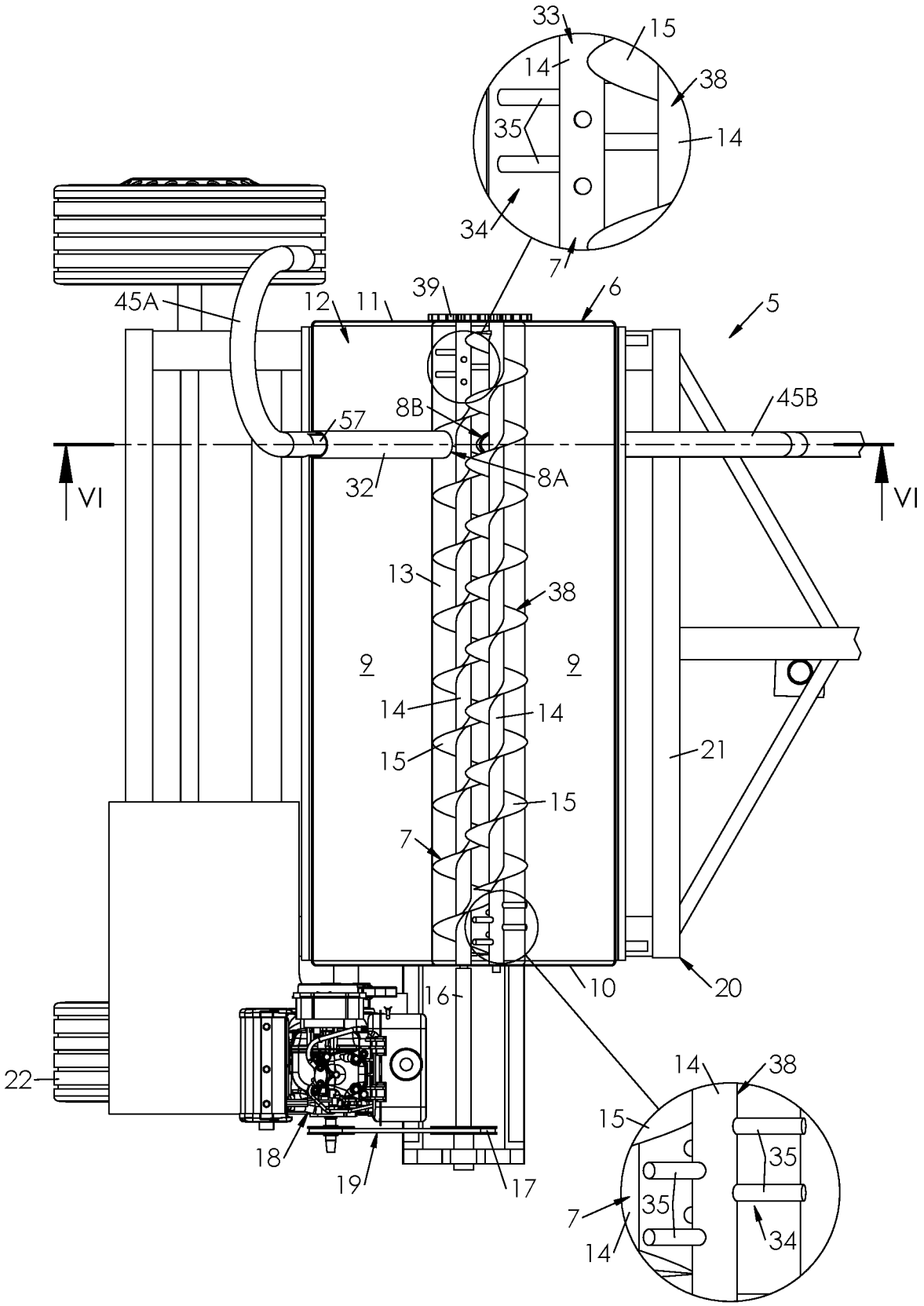
FIG. 4 is a top view of a container within the spraying system; in the magnifying circles, two enlarged details are shown.

As depicted on FIG. 3, the container 5 is provided with a motor 18 (thermal or electrical) which drives in rotation the shaft 14 through the wheel 17, by means of a belt or a chain transmission 19 meshed with the wheel 17. In a preferred embodiment depicted on FIG. 3-FIG. 5, the container 5 comprises a mobile cart 20 provided with a chassis 21, on which the tank 6 and the motor 18 are mounted, and a wheel train 22 rotatably mounted to the chassis 21. The chassis 21 is preferably provided with a latch 23 of the trailer type, whereby the container 5 may be towed by a suitable coupling.

As already stated, the shotcrete 3 is already prepared (and hence wet) when it is poured in the tank 6. The shotcrete 3 may be handmade, but, in a preferred embodiment, the spraying system 4 comprises, to this end, a mixer 24 in which the ingredients are poured, and which prepares the shotcrete 3 therewith.

In the depicted example, the mixer 24 is of the vertical axis-type; it includes a chassis 25, a tank 26 mounted onto the chassis 25, a rotor 27 with blades 28, and a motor 29 coupled to the rotor 27 to drive it in rotation around the axis in order to mix the ingredients with a view to obtaining a homogeneous shotcrete 3.

Figure 2:
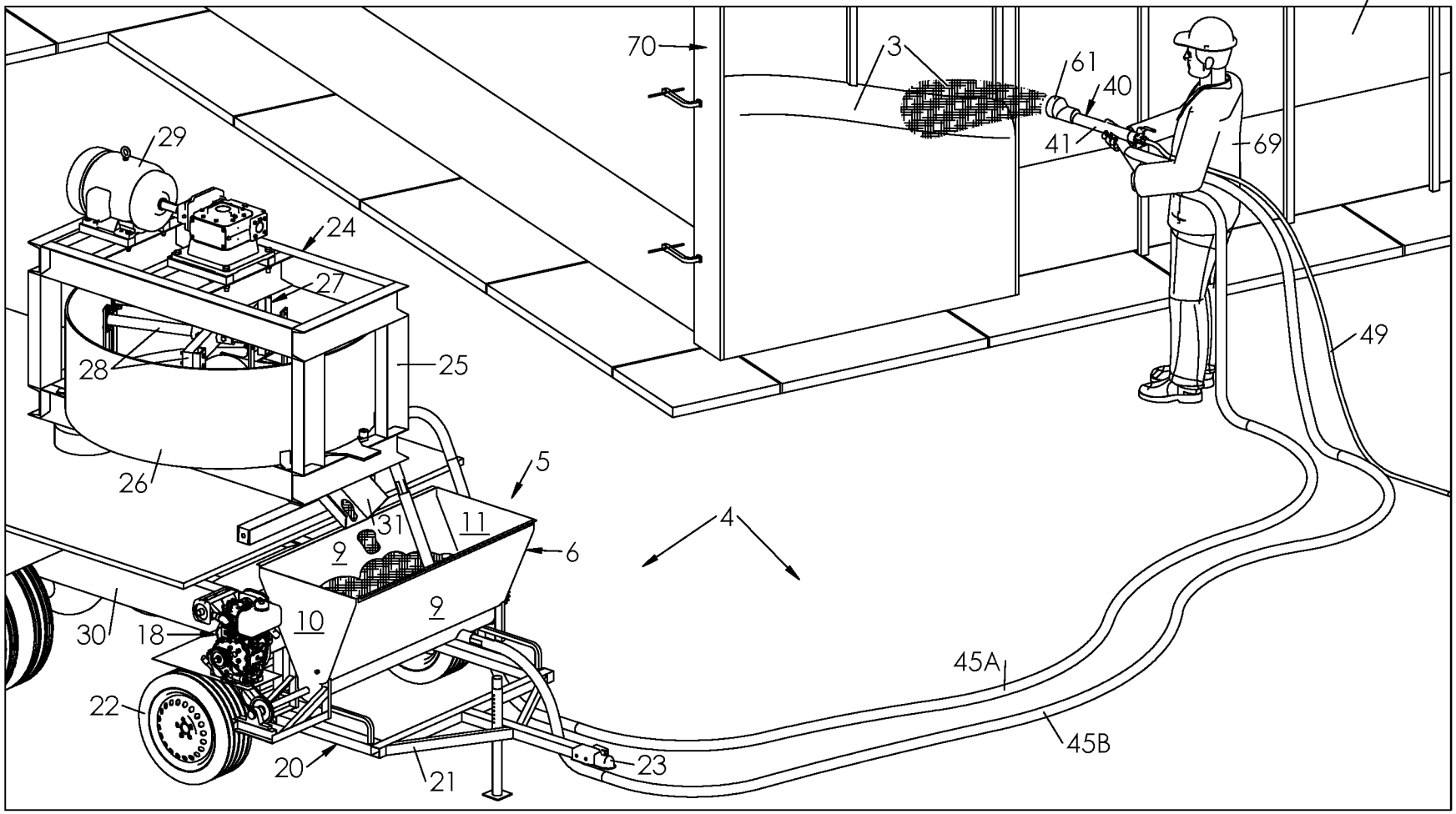
FIG. 2 is a detailed view of the construction site of FIG. 1, at a larger scale.

As may be seen on FIG. 1-FIG. 3, the mixer 24 may be mounted on a utility vehicle 30, such as a pick-up truck. Then, the container 5 is placed below the mixer 24, which is preferably provided with a hatch and a hopper 31 through which, when the hatch opens, the wet shotcrete 3 is poured into the tank 6 of the container 5.

The ingredients of the shotcrete 3 include at least a plant aggregate, a binder and water.

The aggregate is e.g. hemp shive, the volumetric mass (for dry hemp shive) of which is of about 100 kg/m$^3$ when abounded (i.e. not cupped). The binder is e.g. natural quick-setting cement.

The following ranges of mass proportions should be respected:

Aggregate (e.g. hemp shive): 21%-34%

Binder (e.g. natural quick-setting cement): 21%-40%

Water: 35%-44%

Composition example (in mass proportion) for a roof-insulating shotcrete:

Aggregate (e.g. hemp shive): 34.8%

Binder (e.g. natural quick-setting cement): 21.7%

Water: 43.5%

Hence, for 100 kg (or 1000 l) hemp shive, 62.5 kg quick-setting cement and 125 l water.

Composition example (in mass proportion) for a wall-insulating shotcrete:

Aggregate (e.g. hemp shive): 28.6%

Binder (e.g. natural quick-setting cement): 35.7%

Water: 37.5%

Hence, for 100 kg (or 1000 l) hemp shive, 125 kg quick-setting cement and 125 l water.

Composition example (in mass proportion) for a floor-insulating shotcrete:

Aggregate (e.g. hemp shive): 21%

Binder (e.g. natural quick-setting cement): 39.5%

Water: 39.5%

Hence, for 100 kg (or 1000 l) hemp shive, 187.5 kg quick-setting cement and 187.5 l water.

It is better to add to the mixture a set retarder, to prevent the shotcrete 3 from hardening before it has been sprayed, especially when the weather is hot. Ordinarily, the set retarder is e.g. citric acid, e.g. of food quality. The quantity is negligible with respect of that of the main components (aggregate, binder, water); one may respect the ordinary recommendations, which propose to use 80 g of citric acid for one 25 kg sack of natural quick-setting cement (hence 320 g for 100 kg of natural quick-setting cement). Such a quantity is sufficient to delay by a half-hour the setting of the shotcrete, whichever the chosen composition among the three disclosed hereinbefore.

Furthermore, it is preferable to add to the mixture a cohesion agent in order to maintain the shotcrete cohesion during spraying. The cohesion agent may act as a water-retention adjuvant, aiming at enhancing the stability and homogeneity of the shotcrete. Methylcellulose is most recommended, since it provides both functions. The quantity added to the mixture is negligible with respect to those of the main components.

Trials have shown that the quantity of cohesion agent/water-retention agent is preferably proportional to the aggregate mass. In the case of hemp shive, a quantity of water-retention agent (e.g. methylcellulose) of 2% in mass (i.e. 2 kg for 100 kg or 1000 l hemp shive) provides good results, whichever the proportions of binder and water.

One may take advantage, for preparing the shotcrete, of using the following method, which has proven excellent. The dry hemp shive is first poured into the mixer 24; then the methylcellulose, with a mass ratio of 2% with respect of the hemp shive, is added to it. One then leaves the mixer 24 rotate for a few seconds in order for the methylcellulose to coat the hemp shive, and one then adds 1 l water per kg hemp shive. One then adds the binder (e.g. quick-setting cement), and then 0.5 l water per kg binder.

As already stated, the tank 6 of the container 5 is provided with at least one primary outlet 8A, positioned next to the forth worm screw 7. More precisely, the primary outlet 8A opens in or in the vicinity of the bottom 13.

The primary outlet 8A may be formed by a drilling made in the tank 6 (possibly directly in the bottom 13) or, as depicted, by an added tube 32, fixed to a longitudinal wall 9 e.g. by welding. That tube 32 preferably has an inner diameter of 50 mm.

The primary outlet 8A is preferably positioned in the vicinity of the downstream transverse wall 11, at low distance therefrom. As may be seen on FIG. 4, the forth worm screw 7 has a right-handed thread; in such case, it is counter-clockwise driven in rotation by the motor 18 in order to move the poured shotcrete 3 towards the primary outlet 8A. Between the primary outlet 8A and the downstream transverse wall 11, the shaft 14 of the forth worm screw 7 has a downstream end section 33 has no propeller (the propeller 15 stops slightly downstream the primary outlet 8A), but it has a clod breaker 34, here under the form of a series of cylindrical blades 35. The function of this clod breaker 34 is to break up the shotcrete 3 that accumulates around the downstream end section 33.

The tank 6 is preferably provided with a secondary outlet 8B, also positioned next to the forth worm screw 7. The secondary outlet 8B opens in or in the vicinity of the bottom 13, next to the primary outlet 8A. The secondary outlet 8B may be formed by an added tube fixed to a longitudinal wall or, as depicted, directly to the bottom 13 of the tank 6. The secondary outlet 8B is advantageously extended by an added manifold 37, welded to the tank 6. That manifold 37 preferably has an inner diameter of 50 mm.

In a preferred depicted embodiment, the container 5 is provided with a return worm screw 38, mounted parallel to the forth worm screw 7, and driven in rotation in the opposite direction. The return worm screw 38 may be of identical design of the forth worm screw 7, and also comprises a shaft 14 and a propeller 15. The return worm screw 38 is however mounted head to tail with respect to the forth worm screw 7, as shown on FIG. 4. In the depicted example, the return worm screw 38 is located above the forth worm screw 7, and slightly offset transversely, with respect thereto. The propeller 14 of the return worm screw 38 extends from the downstream transverse wall 11 of the tank 6 to a short distance from the upstream transverse wall 10, and has, in the vicinity thereof, a clod breaker 34 of similar design to that of the forth worm screw 7.

The driving of the return worm screw 38 may be achieved by means of the motor 18; inversion of the rotation direction of the return worm screw 38 with respect of the forth worm screw 7 may be achieved by means of a pair of gear wheels 39, mounted on the downstream ends of the screws 7, 38, which protrude from the downstream transverse wall 11.

In consequence, the shotcrete 3 which has not been evacuated by the outlet 8A (or the outlets 8A, 8B) is broken up by the clod breaker 34 of the forth worm screw 7 and moved back upstream by the return worm screw 38. When it reaches the vicinity of the upstream transverse wall 10, the such moved back shotcrete 3 is broken up again by the clod breaker 34 of the return worm screw 38 and falls to the bottom 13 before it is again moved downstream by the forth worm screw 7, to be evacuated by the outlet 8A (or the outlets 8A, 8B). Such recirculation of the shotcrete 3 is repeated until all of it is evacuated.

The spraying system 4 further comprises:

- A spraying gun 40 provided with a barrel 41, a Venturi hose 42 opening in the barrel 41 and at least one primary inlet duct 43A opening in the barrel 41 next to the Venturi hose 42;
- A pressurized air source 44 connected to the Venturi hose 42;
- At least one primary feeding pipe 45A which connects the primary outlet 8A of the tank 6 to the primary inlet duct 43A of the spraying gun 40.

The (or each) feeding pipe 45A is preferably a flexible pipe, possibly reinforced with a helical thread, and preferably has a smooth inner wall and an outer diameter equal (with a possible clearance) to the inner diameter of the tube 32 forming the primary outlet 8A (respectively of the manifold 37 extending the secondary outlet 8B)—hence about 500 mm in the depicted example. In a preferred embodiment, the reinforcing thread is made of metal, in order to conduct electricity. Connecting such thread to the ground then eliminates the static electricity generated by the friction of the material flow against the inner wall of the feeding pipe 45A.

The pressurized air source 44 is preferably under the form of a compressor. That compressor 44 is e.g. mounted onto a sleigh 46 provided with a wheel train 47 and a latch 48 of the trailer type, whereby the compressor 44 may be towed to be transported on the construction site by a vehicle provided with a suitable coupling.

The compressor 44 is connected to the Venturi hose 42 by means of a flexible pipe 49 made of rubber or any other pressure resistant elastomer. The spraying gun 40 is provided with a connector 50 to which the flexible pipe 49 is sealingly connected. The spraying gun 40 is preferably further provided with a valve 51 mounted between the connector 50 and the Venturi hose 42. That valve 51 is e.g. of the quarter-turn type and has a ball 52 rotatably fixed to a handle 53, displacement of which moves the ball 52 to an opening position (depicted on FIG. 10 and FIG. 13) wherein the ball 52 lets the air from the compressor 44 pass, or to a closing position (not shown) wherein the ball 52 seals the air passage.

The spraying gun 40 has a duct 54 which links the connector 50 to the barrel 41; the Venturi hose 42 is under the form of a throttle made in that duct 54 next to the barrel 41. More precisely, the Venturi hose 42 comprises a throttled section 55 (i.e. of lower diameter than that of the duct 54 downstream the ball 52), followed by a diverging section 56 by which the Venturi hose 42 opens into the barrel 41, which has a diameter much larger than that of the duct 54, and more specifically that of the throttled section 55. In a preferred embodiment, the duct 54 has an average diameter D1 comprised between 12 mm and 20 mm, and e.g. of about 14 mm, the throttled section 55 has a diameter D2 comprised between 5 mm and 15 mm, and of about 10 mm, the diverging section 56 (taken at the largest) an outlet diameter D3 of about 20 mm, and the barrel 41 an inner diameter D4 of 50 mm. Such configuration allows, with a work pressure provided by the compressor 44 of about 7-8 bar (for an output flow of about 3000 l/min to 5000 l/min), to obtain in the barrel 41, next to the Venturi hose 42, a depression greater than 0.5 bar (i.e. a pressure lower than 0.5 bar), e.g. comprised between 0.5 bar and 0.99 bar (i.e. a pressure comprised between 0.01 bar and 0.5 bar). The depression is preferably greater than 0.7 bar (i.e. the pressure is lower than 0.3 bar).

Such depression transmits, through the primary inlet duct 43A and the primary feeding pipe 45A, to the primary outlet 8A by which the circulating shotcrete 3 is then sucked.

When, as in the depicted example, the tank 6 comprises two outlets 8A, 8B, i.e. a primary outlet 8A and a secondary outlet 8B, the spraying gun 40 is then provided with a secondary inlet duct 43B opening to the barrel 41, and the spraying system 4 comprises a secondary feeding pipe 45B connecting the secondary outlet 8B to the secondary inlet duct 43B. In such case, the depression in the barrel 41 transmits, through the secondary inlet duct 43B and the secondary feeding pipe 45B, to the secondary outlet 8B by which the circulating shotcrete 3 is then sucked.

Figure 5:
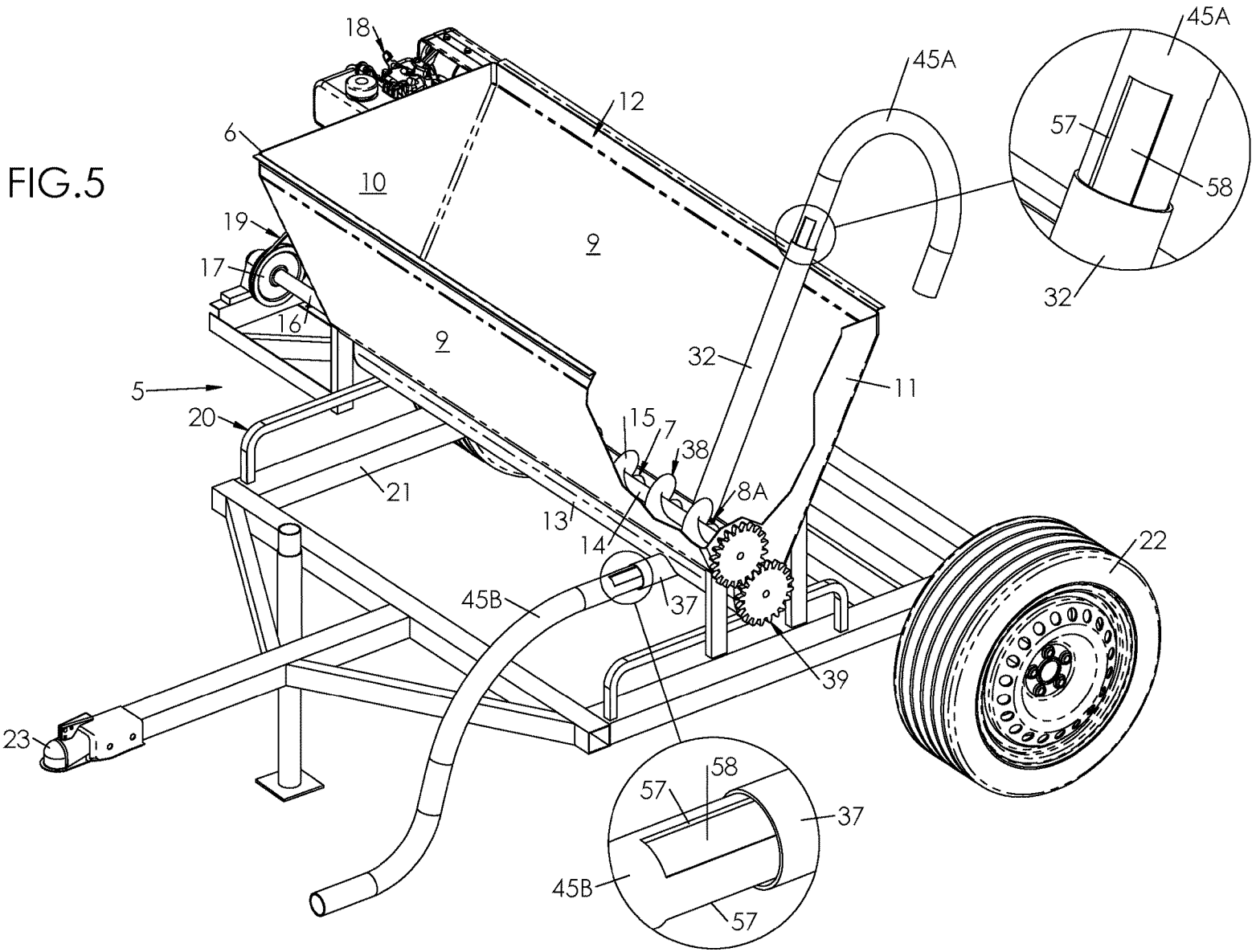
FIG. 5 is a perspective view, partly cut out, of the container of FIG. 4.
Figure 6:
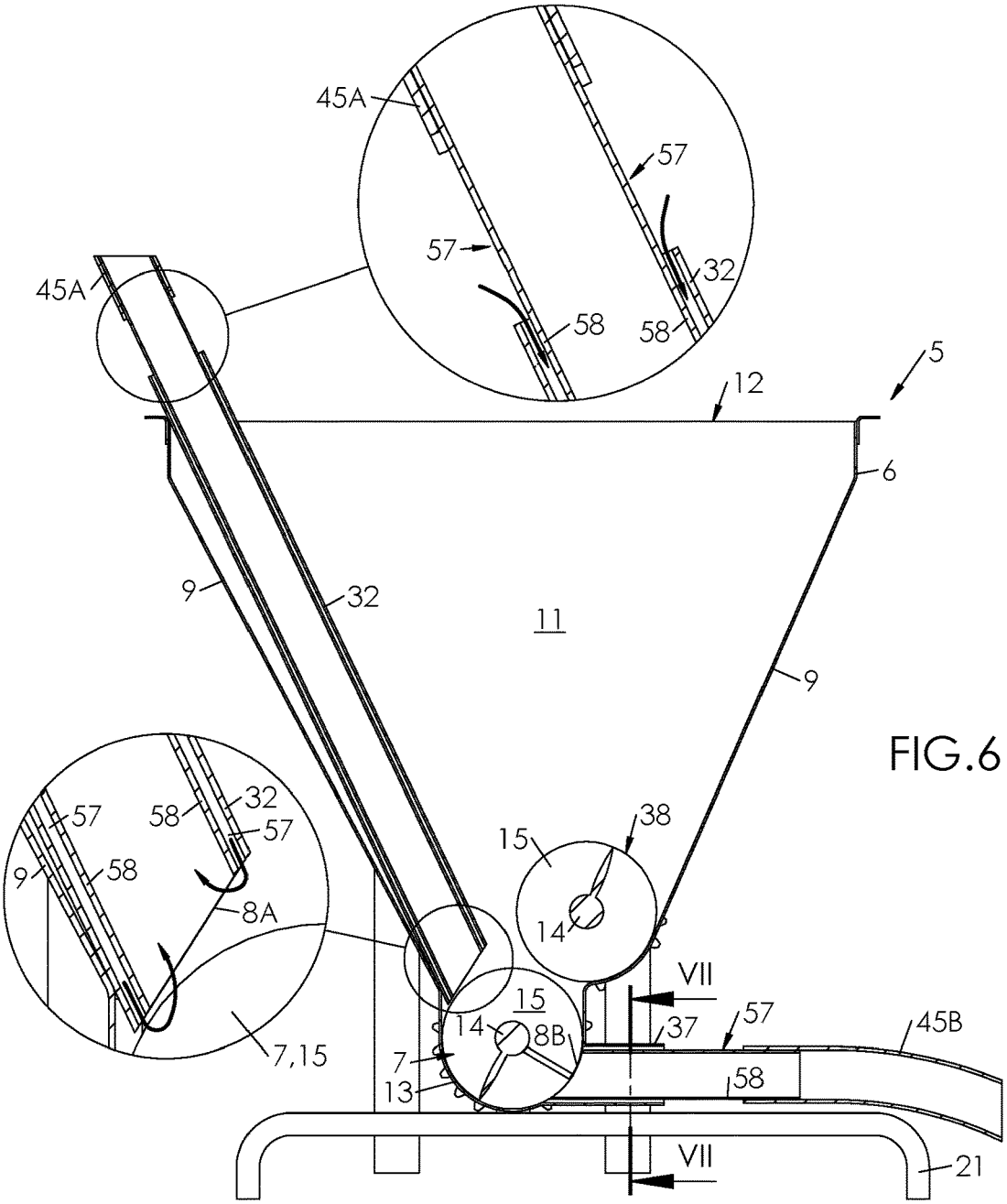
FIG. 6 is a partial cut view of the container of FIG. 4, taken along the cut plane VI-VI.
Figure 7:
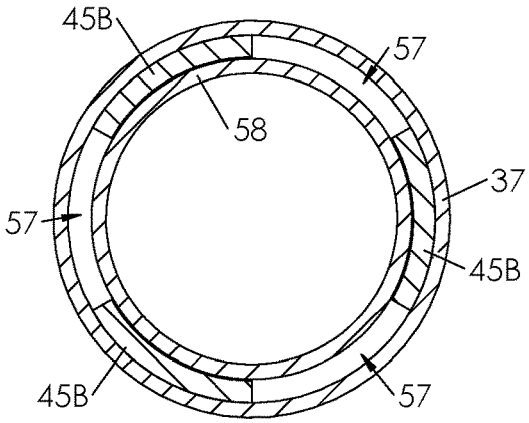
FIG. 7 is a detailed cut view of the container of FIG. 6, taken along the cut plane VI-VI.

In a preferred embodiment depicted on FIG. 5 and FIG. 6, the or each feeding pipe 45A, 45B is provided with one or more slot(s) 57 which protrude from the tube 32 (respectively from the manifold 37) and extend to the outlet 8A (respectively 8B). This (these) slot(s) 57 avoid obstruction of the outlet 8A (respectively 8B) by making air circulation easier under the depression generated by the Venturi hose 42, and hence make the sucking of the shotcrete circulating in the tank 6 easier. In the example depicted on FIG. 7, each feeding pipe 45A, 45B is provided with three slots 57 distributed at 120°. In the depicted example, and e.g. on FIG. 5, FIG. 6 and FIG. 7, each slot 57 goes all through the wall of the feeding pipe 45A, 45B, and the feeding pipe 45A, 45B is mounted on a tube 58 which extends from the respective outlet 8A, 8B to beyond the slot 57. In an alternate embodiment, each slot 57 is dug in the feeding pipe 45A, 45B without going through it.

Figures 8, 9, 10:
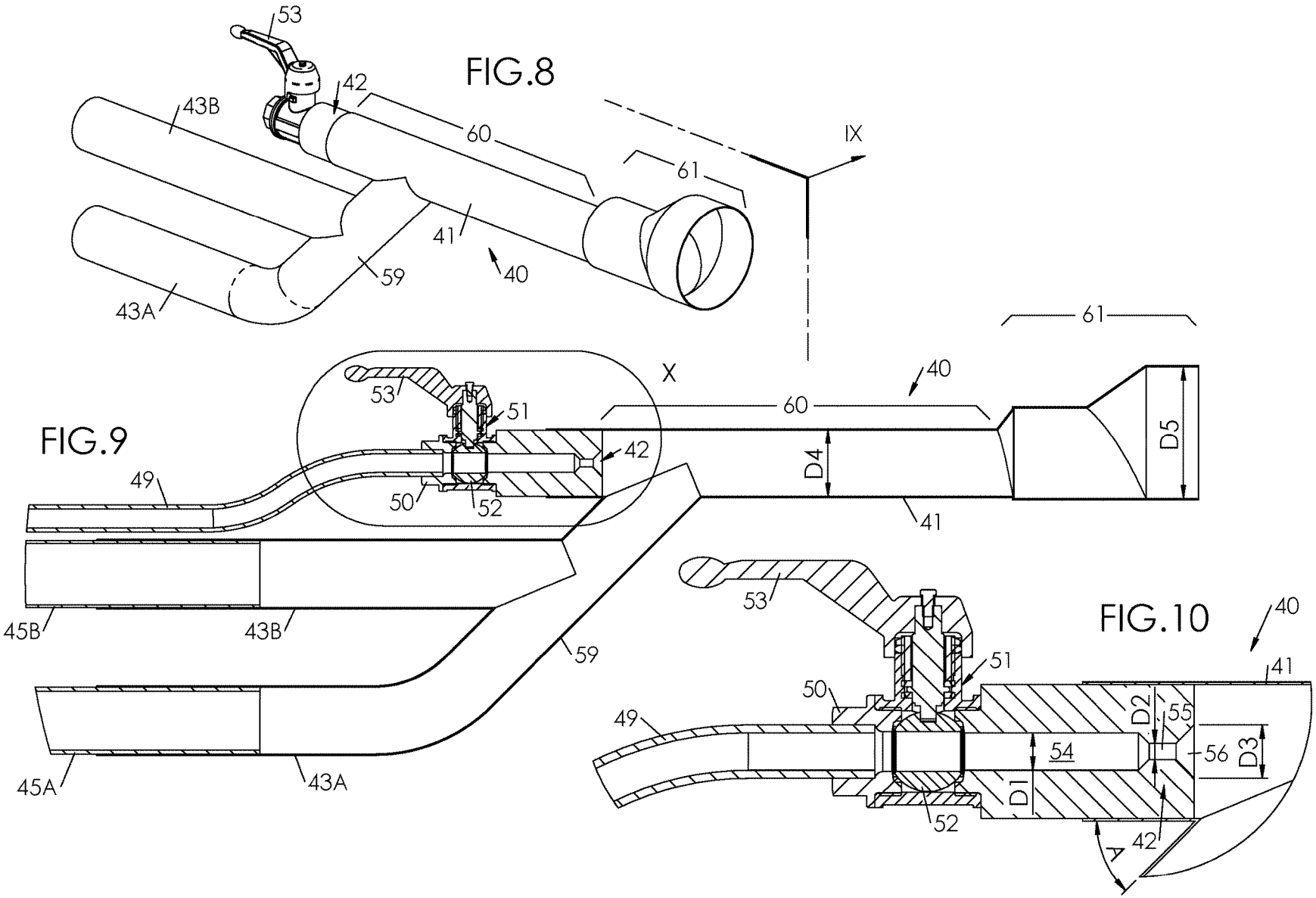
FIG. 8 is a perspective view of a spraying gun within the spraying system, in a first embodiment.
FIG. 9 is a cut view of the spraying gun of FIG. 8, taken along the cut plane IX.
FIG. 10 is a detailed view of the spraying gun of FIG. 9, taken in the magnifying circle IX.
Figure 11:
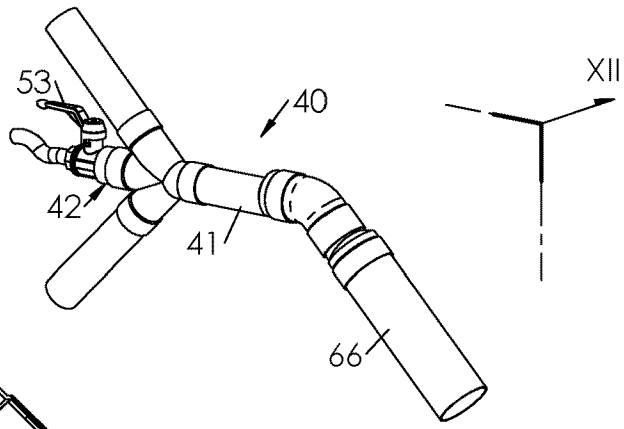
FIG. 11 is a perspective view of a spraying gun within the spraying system, in a second embodiment.

In a first embodiment shown on FIG. 8, FIG. 9 and FIG. 10, the spraying gun 40 comprises superposed primary inlet duct 43A and secondary inlet duct 43B, which both open in the barrel 41 through a collector manifold 59 preferably inclined by an angle A of about 45° with respect to the barrel 41. The barrel 41 has a main section 60 of constant diameter D4 (i.e. of about 50 mm in the depicted example), and it also preferably has an end section 61 of greater diameter (that diameter, D5, is preferably comprised between 60 mm and 90 mm, e.g. of about 70 mm) the function of which is to reduce the flow speed of the shotcrete 3 to minimize bouncing against the surface to coat, while forming a diverging spray allowing for the coated surface to be increased.

Figure 12:
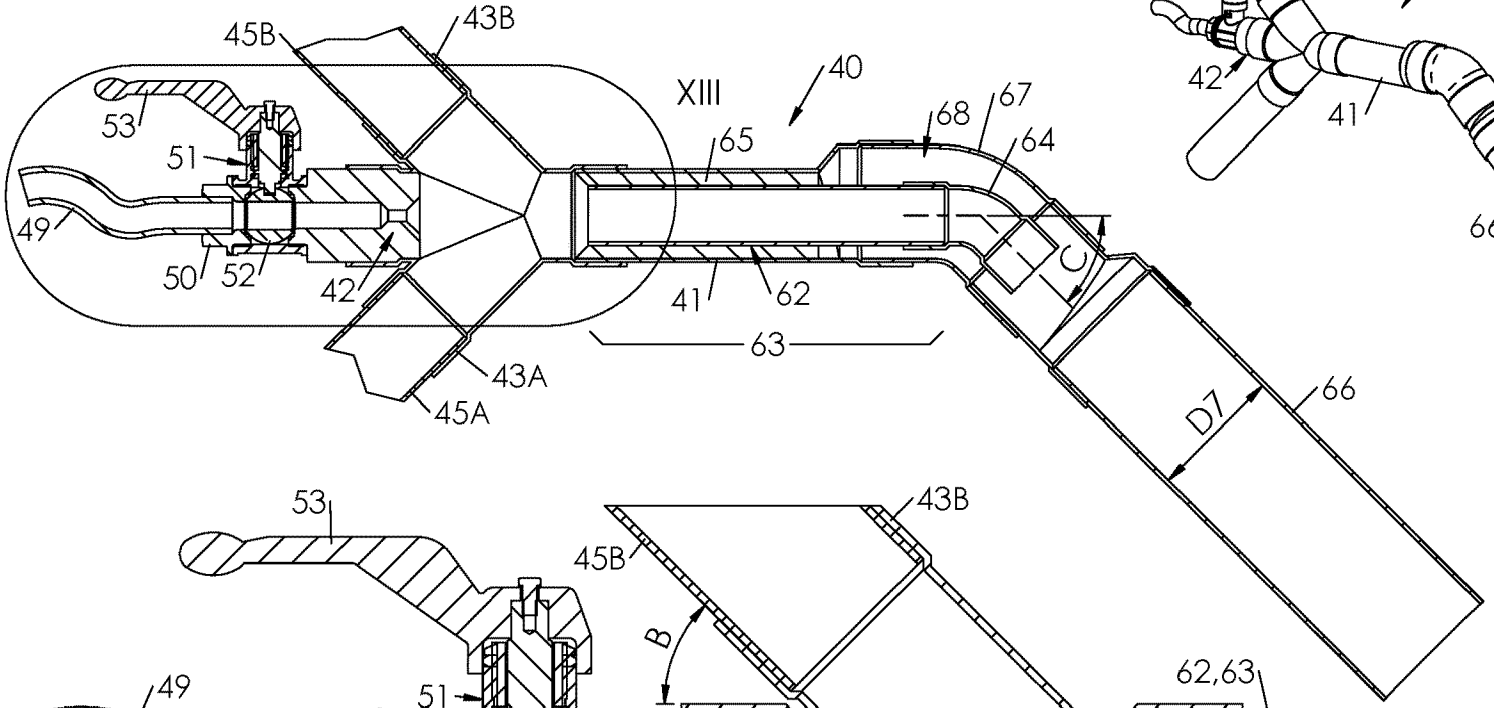
FIG. 12 is a cut view of the spraying gun of FIG. 11, taken along cut plane XII.
Figure 13:
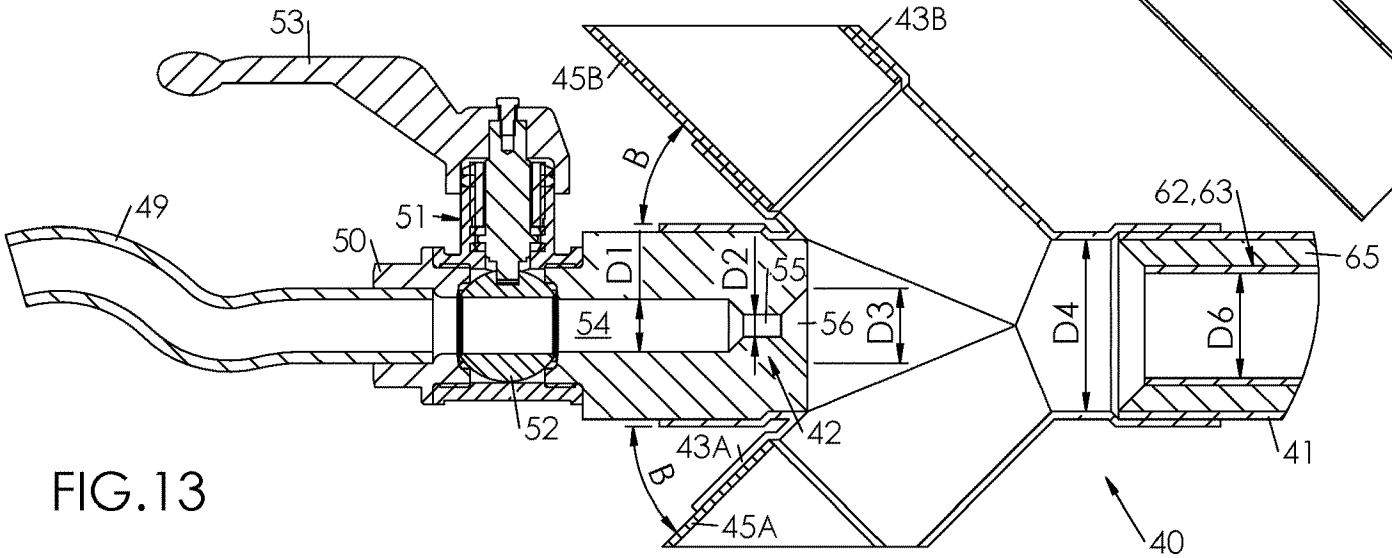
FIG. 13 is a detailed view of the spraying gun of FIG. 12, taken in the magnifying circle XIII.

In a second embodiment shown on FIG. 12 and FIG. 13, the spraying gun 40 comprises a primary inlet duct 43A and a secondary inlet duct 43B which are symmetrical with respect to the barrel 41, in which they both open next to the Venturi hose 42, preferably with an angle B of about 45° in the depicted example.

Downstream the junction between the inlet ducts 43A, 43B and the barrel 41, the latter comprises a lower diameter section 62, (that diameter D6 is preferably comprised between 30 mm and 45 mm, and e.g. of about 40 mm). That lower section 62 includes a straight section 63, the length of which is comprised between 150 mm and 300 mm (and e.g. of about 200 mm), and a bent portion 64 which extends the straight section 63 and forms therewith an angle C which is preferably comprised between 30° and 50°, and e.g. of about 45°. The straight portion 63 may be formed by fitting a low diameter tube (between 30 mm and 50 mm, and e.g. of about 40 mm) within an outer ending tube of greater diameter (e.g. of about 50 mm) with a filling and air-sealing product 65 therebetween, such as a closed cell polymer foam. As depicted on FIG. 12, the lower diameter section 62 opens in a greater diameter section 66 (that diameter D7 is preferably greater than 90 mm, e.g. of about 120 mm), with an aim to decrease the flow speed of the shotcrete 3 to minimize the bouncing on the surface to coat, while forming a diverging spray allowing for the coated surface to be increased.

In addition, in the example depicted on FIG. 12, the greater diameter section 66 partly overlaps the lower diameter section 62, and has a bent outer section 67 which connects thereto upstream its opening, in order to create around the bent portion 64 a decompression chamber 68 aiming at generating turbulences in the shotcrete flow thereby lowering its speed and allowing its spraying in small clods instead of large clods and its spreading on the surface to coat.

An outer diameter ending section 61 may be added to the barrel 41, such ending section 61 allowing, through pressure loss, to slow the shotcrete flow down, thus lowering the risk of the material bouncing onto the surface to coat.

To coat the support 2 (e.g. a wall) by means of the lightweight insulating shotcrete 3, the composition of which is provided hereinbefore, one may proceed as follows.

A first phase consists in preparing the shotcrete 3 by mixing predetermined proportions (see above) the fibrous plant aggregate (here the hemp shive), the binder (here the fast setting cement) and the water, possibly with addition of the set retarder (such as citric acid) and the water retainer adjuvant such as methylcellulose). That mixture may be hand-made but it is preferable to make it with the mixer 24.

After having obtained a homogeneous shotcrete 3, a second phase consists of pouring the prepared wet shotcrete (in grey on FIG. 2) in the container 5, and more precisely in the tank 6, the worm screws 7, 68 having been actuated. To pour the wet shotcrete 3 from the mixer 24 into the tank 6, one opens the hatch. The shotcrete 3 falls in the tank 6 through the hopper 31.

A third phase consists in continuously circulating the wet shotcrete 3 in the tank 6 until it reaches the outlet 8A (or the outlets 8A, 8B). Such circulation is achieved by means of the worm screw 7 (or the worm screws 7, 38), commonly (and reversely) driven in rotation by the motor 18. The clod breaker(s) 34 break up the aggregates that possibly form in the vicinity of the downstream transverse wall 11 (respectively the upstream transverse wall 10).

A fourth phase consists in sucking the wet shotcrete 3 along the feeding pipe 45A (or feeding pipes 45A, 45B) linking the outlet 8A (respectively the outlets 8A, 8B) of the tank 6 to the spraying gun 40, by means of the Venturi hose 42 fed with pressurized air by the compressor 44, and spraying the sucked wet shotcrete 3 onto the support 2, by means of the spraying gun 40.

The slots 57 formed in the feeding pipe 45A (or the feeding pipes 45A, 45B) make the air circulation easier (as illustrated by the arrows in the magnifying details of FIG. 6) and avoid clogging of the outlet 8A (or outlets 8A, 8B) by the shotcrete 3. The shotcrete 3 is sucked in the feeding pipe 45A (or the feeding pipes 45A, 45B) in small sized clods (of several $mm^3$ to several $cm^3$) which hence do not clog either the feeding pipe 45A (or the feeding pipes 45A, 45B) or the spraying gun 40 and are sprayed onto the surface to coat at a speed which, as suggested above, may be varied by setting the diameter of the barrel 41. The architecture of the spraying system 4 allows to obtain a spraying flow rate greater than 2 $m^3$/h, and possibly up to 3 $m^3$/h. To coat a wall 2 having a length of 10 m and a height of 3.3 m with a lightweight insulating shotcrete 3 of a 15-cm thickness (i.e. an approximate volume of 5 $m^3$), 2-3 hours spraying are sufficient (with a lone operator 69 having a single spraying gun 40). If the operator is alone on the construction site, he should add the time for preparing the shotcrete 3 (e.g. by successive rounds of 100 l), unless the shotcrete 3 is continuously prepared, e.g. by a second operator dedicated to it, whereby the preparation time of the shotcrete is not taken into account.

It may be preferred, for the insulating of the walls, to prepare guides 70 (such as boards) aiming at ensuring that the surface of sprayed shotcrete is planar and constant in thickness. After having filled the space between guides 70, the operator may smooth over the sprayed shotcrete 3 with a mason's ruler. If the shotcrete is still wet enough, the ruled shotcrete may be recycled and poured in the container 5 again.

The spraying system 4 and method disclosed hereinbefore provide several benefits.

First, being able to spray the wet-mix shotcrete 3 (the shotcrete is prepared and wet before it is sucked) allows for optimizing water consumption, as the water rate of the shotcrete 3 is lower than that of a handcrafted concrete.

Secondly, as the shotcrete 3 is wet when sprayed, it generates no dust while being sprayed, unlike the dry-mix shotcretes. Dust may be produced when the aggregate and the cement are poured into the mixer 24, but they may be contained by means of a lid or a fabric covering the tank 26.

Thirdly, as the spraying speed may be adjusted, and as the shotcrete 3 is sprayed in a wet-mix version after having been sufficiently mixed (i.e. there is no more aggregate unimpregnated with binder and water), its adherence to the support is good, whereby the bouncing (and hence the loss) is minimized.

Finally, the efficiency of the sucking generated by the Venturi hose 42, the dimensions of the feeding pipe 45A (or the feeding pipes 45A, 45B), the structure of the container 5 and the spraying gun 40, together allow for good spraying rates, and hence for enhancing the actual production yield. One may observe that the presence of hemp in the barrel 41 reduces the passage section and hence increases the depression at the Venturi hose 42, thereby increasing its sucking force.

One may note that the spraying system 4 may be used for spraying dry-mix shotcrete, as the Venturi hose 42 is capable of sucking lone aggregate, which may be wet and added with binder as it exits the spraying gun 40.

The invention claimed is:

1. A system for spraying lightweight insulating shotcrete, comprising:

a container provided with a tank and at least one first worm screw rotatably mounted in the tank, the tank having one primary outlet facing the at least one first worm screw and one secondary outlet positioned next to the at least one first worm screw;

a spraying gun provided with a barrel, with a Venturi hose comprising a throttled section followed by a diverging section by which the Venturi hose opens in the barrel, with a primary inlet duct and a secondary inlet duct which are symmetrical with respect to the barrel, in which they both open next to the Venturi hose;

a pressurized air source connected to the Venturi hose;

one primary feeding pipe connecting the primary outlet of the tank to the primary inlet duct of the spraying gun;

one secondary feeding pipe connecting the secondary outlet of the tank to the secondary inlet duct, wherein, downstream a junction between the primary and secondary inlet ducts and the barrel, the barrel comprises a lower diameter section opening in a greater diameter section.

2. The spraying system according to claim 1, wherein the container comprises a second worm screw mounted parallel to the at least one first worm screw and driven in rotation in a opposite direction as compared to the at least one first worm screw.

3. A method for coating a support by means of a lightweight insulating shotcrete, the method comprising:

providing the system of claim 1;

preparing wet shotcrete by mixing, in predetermined proportions, at least a fibrous aggregate, a binder, and water;

pouring the wet shotcrete in the tank;

continuously moving the wet shotcrete in the tank until the wet shotcrete reaches the primary outlet and the secondary outlet;

sucking the wet shotcrete along the primary and the secondary feeding pipes by means of the Venturi hose fed with pressurized air from the pressurized air source; and spraying the sucked wet shotcrete onto the support by means of the spraying gun.

4. The method according to claim 3, wherein the aggregate is hemp shive.

5. The method according to claim 3, wherein the binder is natural quick-setting cement.

6. The method according to claim 3, wherein the preparing of the wet shotcrete further includes adding a water retainer adjuvant.

7. The method according to claim 3, wherein the preparing of the wet shotcrete further includes adding a set retarder.

8. The method according to claim 3, wherein the pressure inside the spraying gun next to the Venturi hose is lower than 0.3 bar.

9. A method for coating a support by means of a lightweight insulating hemp shive shotcrete, the method comprising:

providing the system of claim 1;

preparing wet shotcrete by mixing hemp shive, a binder, water, and methylcellulose in the following mass proportions:

Hemp shive: 21%-34%

Binder: 21%-40%

Water: 35%-44%

Methylcellulose: 2% of hemp shive;

pouring the wet shotcrete in the tank;

turning the at least one first worm screw to move the wet shotcrete in the tank until the wet shotcrete reaches the primary outlet and the secondary outlet;

feeding the Venturi hose with pressurized air from the pressurized air source;

sucking the wet shotcrete along the primary feeding pipe and the secondary feeding pipe to the spraying gun; and spraying the sucked wet shotcrete on the support by means of the spraying gun.

* * * * *